United States Patent [19]

Embry et al.

[11] Patent Number: 5,022,243

[45] Date of Patent: Jun. 11, 1991

[54] LATCHING SYSTEM

[75] Inventors: Donald Embry, Daviess County, Ky.; Woodrow C. Stillwagon, Fulton County, Ga.

[73] Assignee: Star Lock Company, Norcross, Ga.

[21] Appl. No.: 403,665

[22] Filed: Sep. 6, 1989

[51] Int. Cl.[5] ..... E05B 67/36

[52] U.S. Cl. ..... 70/34; 70/208

[58] Field of Search ..... 70/34, 365, 378, 491, 70/419, 418, 207, 208

[56] References Cited

U.S. PATENT DOCUMENTS

| | | | |
|---|---|---|---|
| 951,836 | 3/1910 | Noack | 403/383 |
| 1,577,678 | 3/1926 | Behrman . | |
| 1,592,696 | 7/1926 | Heyer | 70/34 |
| 1,829,760 | 11/1931 | Santiago | 24/136 |
| 1,975,877 | 11/1934 | Thomas | 403/328 |
| 2,062,628 | 12/1936 | Yannetta | 24/136 |
| 2,514,760 | 7/1950 | Hanson et al. | 24/136 |
| 3,177,543 | 4/1965 | Fountain | 24/126 |
| 3,240,519 | 3/1966 | Weasler | 403/325 |
| 3,260,541 | 7/1966 | Sadler et al. | 403/325 |
| 3,478,548 | 11/1969 | Finck, Jr. | 70/34 X |
| 3,525,242 | 8/1970 | Young | 70/34 X |
| 3,911,534 | 10/1975 | Martens et al. | 24/150 |
| 3,947,930 | 4/1976 | Martens et al. | 24/155 |
| 3,948,362 | 4/1976 | Greest | 188/65.2 |
| 3,974,581 | 8/1976 | Martens et al. | 40/20 |
| 3,994,521 | 11/1976 | Van Gompel | 292/319 |
| 4,012,813 | 3/1977 | Martens et al. | 24/150 |
| 4,141,117 | 2/1979 | Van Gompel | 24/136 |
| 4,221,025 | 9/1980 | Martens et al. | 24/150 |
| 4,328,687 | 5/1982 | Ritchie | 70/34 |
| 4,361,196 | 11/1982 | Hoyle | 403/383 |
| 4,440,005 | 4/1984 | Bulle | 70/34 X |
| 4,527,310 | 7/1985 | Vandebult | 24/150 |
| 4,552,001 | 11/1985 | Roop | 70/208 |
| 4,579,476 | 4/1986 | Post | 403/322 |
| 4,617,844 | 10/1986 | Batten | 403/383 |
| 4,637,234 | 1/1987 | Mielonen | 70/34 |
| 4,639,163 | 1/1987 | Buthe et al. | 403/322 |
| 4,656,698 | 4/1987 | Arakaun | 24/136 |
| 4,683,739 | 8/1987 | Hughes | 70/378 X |
| 4,716,749 | 1/1988 | Johnson | 70/378 X |
| 4,730,468 | 3/1988 | Becker | 70/34 |
| 4,760,721 | 8/1988 | Steinbach | 70/208 |
| 4,900,182 | 2/1990 | Stillwagon | 403/325 |

OTHER PUBLICATIONS

Quick Acting Fasteners for Removable Panels, Covers, and Subassemblies DZUS Fastener Co. Inc.—see specifically highlighted areas.

*Primary Examiner*—Robert L. Wolfe
*Assistant Examiner*—Suzanne L. Dino
*Attorney, Agent, or Firm*—Louis T. Isaf

[57] ABSTRACT

A Latching System comprises a notched post assembly, a post gripping assembly and a handle assembly, and, in preferred embodiments, a lock assembly associated with the handle assembly, wherein the notched post assembly is comprised of an elongated post formed at one end with at least two opposing, axially extending rows of notches or teeth and alternately disposed smooth surfaces and the post gripping assembly comprises a channel for accepting the notched end of the post and comprises movable cam elements which cooperate with the notches of the post to effect the primary latching function of the system; and wherein the unlatching of the post from the channel is accomplished by rotating the post to disengage the notches and the cam elements. A pick-resisting improvement to the cylinder lock assembly includes facial piece defined with a plurality of knobs protruding partly into the key entry passage of the lock assembly.

32 Claims, 7 Drawing Sheets

| POSITION | DEGREES | | |
|---|---|---|---|
| 1 | 0° | 4 | 180° 00′ |
| 2 SLOT | 73° 55.7′ | 5 SLOT | 253° 55.7′ |
| 3 | 115° 42.9′ | 6 | 295° 42.9′ |
| | | 7 | 360° 00′ |

| POSITION | DEGREES |
|---|---|
| 1 | 0° |
| 2 | 31° 50.8′ |
| 3 | 66° 06.9′ |
| 4 | 113° 53.1′ |
| 5 | 148° 09.2′ |
| 6 | 211° 50.8′ |
| 7 | 246° 06.9′ |
| 8 | 293° 53.1′ |
| 9 | 328° 09.2′ |
| 10 | 360° 00′ |

LATCHING SYSTEM

FIELD OF THE INVENTION

This invention relates generally to the field of latching devices and, in its most preferred embodiments, to the field of key operated door latching devices.

BACKGROUND OF THE INVENTION

A latching device holds lids, doors, and other closure pieces in a closed position on related boxes, cabinets, vending machines, doorways and other framed structures. When desired to maintain the structure secure, the latch mechanism is provided with a locking device, such as a keyed lock. There are great numbers of latching and locking devices available on the market, yet not all these devices are capable of meeting the needs of high security areas and/or withstanding the demands of high impact and abusive areas.

By way of example, but not limitation, one high security and abusive area requiring specially designed latching and locking devices is that of vending machines. Hordes of vandals have taken a large toll on the vending machine industry, pilfering millions of dollars yearly from destroyed or illegally accessed money boxes. Vandals use numerous methods, including the use of professional tools, with varying degrees of brutality, to open the door and access the money. Needless to say, the industry is desperately seeking new latching and locking devices which will thwart the efforts of the vandals and otherwise provide tight, secure and dependable latching and locking.

SUMMARY OF THE INVENTION

Briefly described, the latching system of the present invention comprises a notched post assembly, a post latching assembly, and a handle assembly. In preferred embodiments, the invented latching system also includes a lock assembly associated with the handle assembly. The post assembly and post latching assembly are, in a preferred application, cooperatively mounted each to one of a closure piece (hereinafter generally referred to as the "door") and a related framed structure (hereinafter generally referred to as the "door frame").

The notched post assembly is comprised, in the preferred embodiment, of an elongated post formed at one end with at least two opposing, axially extending rows of notches or teeth. The post is mounted at its other end to a mounting assembly for rotation within the mounting assembly about the axis of the post. The post latching assembly comprises a channel for accepting the notched end of the post and comprises movable latch elements which cooperate with the notches of the post to effect the primary latching function of the system. The cooperation of the post notches and the latch elements allows for entry of the notched end of the post into the latching assembly channel, but resists removal of the post from the channel. Removal ("unlatching") of the post from the channel is accomplished by rotating the post to disengage the notches and the latch elements, thus allowing for removal of the post from the latching assembly.

Rotation of the post to effect unlatching is accomplished by action of the handle assembly. In its basic form, the preferred embodiment of the handle assembly includes a handle of some definition engaging, for example, the mounted end of the post. In the preferred embodiment, the lock assembly performs the function of the handle as well as performs the primary locking function. The primary locking function is that function of preventing rotation, and thus preventing unlatching, of the post without proper operation of a key or appropriate combination or code. The lock assembly of the preferred embodiment is of a type typically known in the art, comprising a casing, a core and a locking linkage between said casing and said core, whereby, when the linkage is unlocked as by a key or combination, the core is rotatable about an axis within said casing and, when the linkage is locked, the core and casing are prevented from relative movement. The lock assembly is coupled to the mounted end of the post so as to effect release of the latching function of the post and post latching assembly when the core experiences relative movement within the casing.

In a preferred embodiment of the present invention, the lock assembly is of a tubular, cylinder-lock type and is defined with a "pick-resisting" facial piece previously unknown to the lock industry. This pick-resisting facial piece includes a plurality of knobs protruding partly into the key entry passage of the lock assembly to obstruct the key passage during exercise of some of the more popular lock picking methods.

In a preferred application, the mounting assembly (to which the post is mounted), is rigidly attached to a door, with the post assembly rotatably supported within the mounting assembly, and the post latching assembly is rigidly attached to the door frame. Alignment of the post assembly and the post latching assembly is such that, as the door is closed, the post engages and protrudes into the channel of the latching assembly. To effect the latching function of the present invention, the rows of notches of the post are, upon protrusion of the post into the latching assembly channel, aligned with the latch elements of the latching assembly. In the embodiments incorporating a lock assembly, the interface linkage between the lock assembly and the post functions such that the latching function of the post and post latching assembly can not be released except through operation of the key or combination of the lock assembly.

In still another, preferred, yet alternate embodiment, the handle assembly includes a cinching mechanism utilizing cooperating cam surfaces functioning to mechanically draw the door closer to the door frame. Furthermore, in this embodiment, special detail and tolerances have been developed to accommodate retrofit of the "Improved Latching System" of the present invention into the mounted framework of existing vending machine latching systems.

It is, therefore, an object of the present invention is to provide a latching system to assist in deterring vandals.

Another object of the present invention is to provide a latching system which is durable and capable of holding a door and door frame in a latched manner in the face of abusive treatment.

Still another object of the present invention is to provide a latching system which effects strong latching between latch components yet is quickly and easily unlatched.

Yet another object of the present invention is to provide a "pick-resisting" lock assembly.

Another object of the present invention is to provide a latching system with quick cinching function for easily drawing the door and door frame tightly together.

Still another object of the present invention is to provide an improved latching system which can be retrofit to existing framework.

Another object of the present invention is to provide an improved latching system which allows for a secondary, fixed position lock.

Other objects, features and advantages of the present invention will become apparent upon reading and understanding the present specification, with the referenced parent specification, when taken in conjunction with the appended drawings.

DETAILED DESCRIPTION OF THE INVENTION

Figure 1:
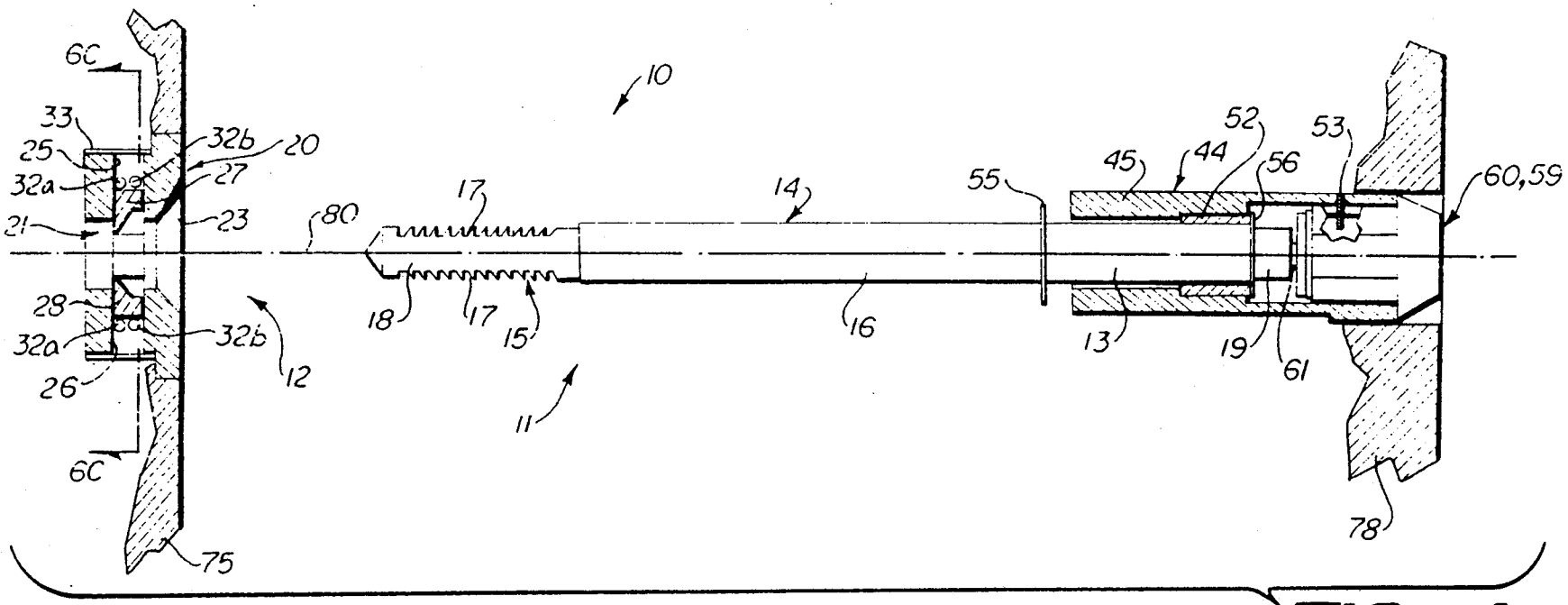
FIG. 1 is a side view of the Improved Latching System in accordance with the present invention, with parts cut away for clarity and with latching components unconnected and unsupported by closure pieces.
Figure 2A:
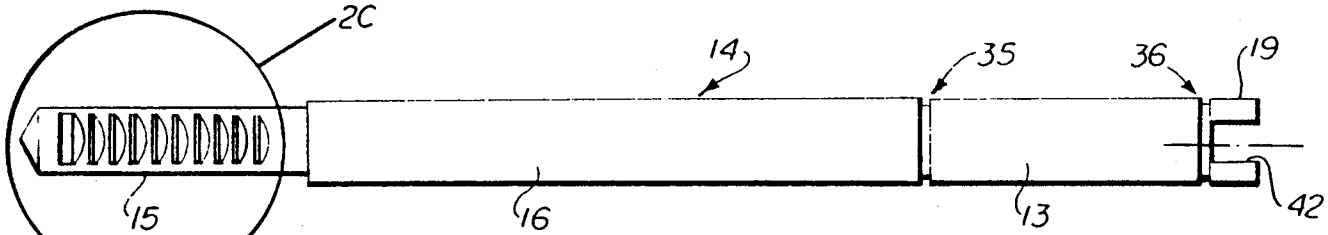
FIG. 2A is an isolated, top view of a post assembly of the Latching System of FIG. 1.
Figure 2B:
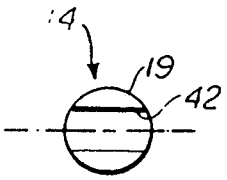
FIG. 2B is an end view of the isolated post assembly of FIG. 2A, seen from the right end of FIG. 2A.
Figure 2C:
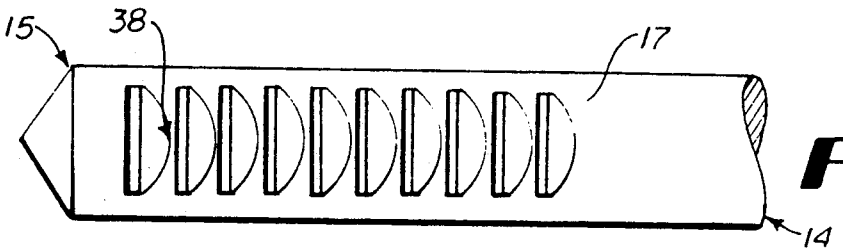
FIG. 2C is an isolated, enlarged view of that top view of the portion of the post assembly as indicated by the circle of FIG. 2A.
Figure 2D:
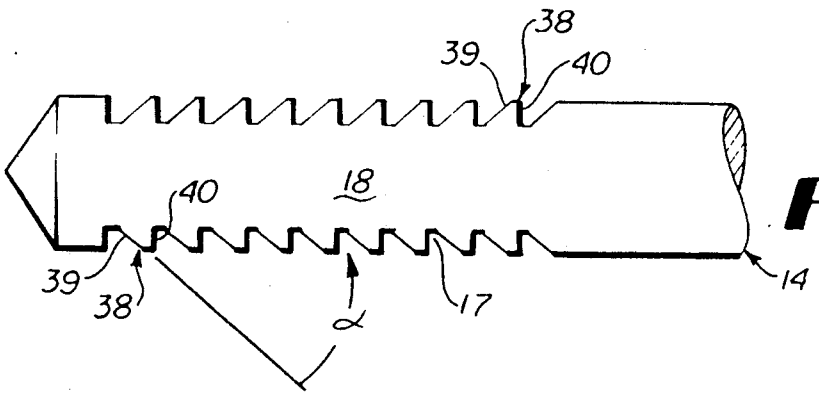
FIG. 2D is a view of the isolated portion of the post assembly seen in FIG. 2C, seen from what would be the side view of FIG. 1 and the top of FIG. 2C.
Figure 2E:
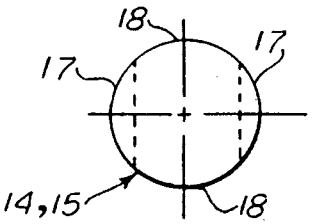
FIG. 2E is an end view of the isolated post assembly of FIG. 2C, seen from the left end of FIG. 2C.

Referring now in greater detail to the drawings in which like numerals represent like components throughout the several views, a preferred embodiment of the latching system 10 of the present invention is seen in FIG. 1 as comprising a post assembly 11, a post latching assembly 12, and a handle assembly 60. A mounting assembly 44 is, in the disclosed embodiment, associated with the post assembly 11 and the handle assembly 60. The post assembly includes, generally, an elongated post 14. The post 14 of the preferred embodiment (with reference to FIGS. 1 and 2A-2E) is seen as including a mounting portion 13, a latching portion 15, a post extension portion 16 and a coupling portion 19. The mounting portion 13 is that portion by which the post 14 is mounted to the mounting assembly 44 see FIG. 1). The mounting portion 13 is defined between two annular grooves 35, 36. The latching portion 15 is defined at the end of the post 14 opposite the mounting portion 13, and is that portion by which the post is "gripped" by the post latching assembly 12 to effect the primary latching function of the latching system 10. The latching portion 15 is formed as a "multi-surfaced" segment; that is, the surface of the latching portion alternates, about opposite quadrants of this post 14, between notched surfaces 17 and smooth surfaces 18. One embodiment of the latching portion 15 is seen in greatest detail in FIGS. 2C, 2D, 2E, and includes two notched surfaces 1 and two smooth surfaces 18. Each notched surface 17 of the illustrated embodiment includes a single row of arcuate teeth 38, which teeth each are formed with a rearwardly tapered leading surface 39 and a radially extending trailing surface 40. The row of teeth 38 of each notched surface 17 extends lengthwise along the latching portion 15 of the post 14. Each tooth 38 extends crosswise across the respective notched surface 17. The post 14 length is varied, depending on the application, by the length of the extension portion 16. The coupling portion 19 of the preferred embodiment is seen in FIGS. 2A and 2B as including a channel 42 formed along the diameter of the post 14.

Figure 3B:
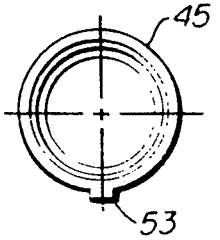
FIG. 3B is an end view of the isolated mounting assembly of FIG. 3A, seen from the right end of FIG. 3A.
Figure 3A:
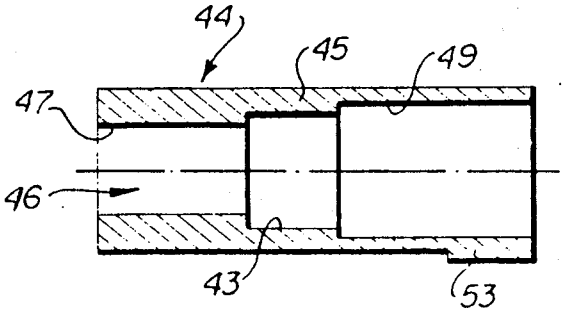
FIG. 3A is an isolated, cutaway side view of a mounting assembly of the Latching System of FIG. 1.

The mounting assembly 44, seen in a first, preferred embodiment in FIGS. 1, 3A and 3B, is comprised mainly of a support housing 45 and bearing assembly 52.

The support housing 45 is generally cylindrical and is formed with an axial passage 46 of three chambers: the narrower, post support chamber 47 of first diameter; the bearing chamber 48 of second diameter; and the coupling chamber 49 of third diameter. A cylindrical bearing assembly 52 is press-fitted into the bearing chamber 48. The support housing 45 also includes an elongated rib 53 protruding from the housing cylinder. As is noted from FIG. 1, the post 14 is mounted at its mounting portion 13 within the support housing 45, rotatably supported by the bearings 52. An external locking ring 55 occupies the outer annular groove 35 of the post 14 and a spring bearing disc 56 occupies the inner annular groove 36. In the preferred embodiments, the external locking ring 55 functions, at least, to protect the post 14 from being pushed to far into the housing 45; and the spring bearing disc 56 functions, at least, to prevent the post from pulling out of the housing. Furthermore the spring action of the spring bearing disc 56, preferably, functions to provide a degree of flexability when mounting in various die cast lock assemblies.

The handle assembly 60 is mounted within the coupling chamber 49 of the mounting housing 44. (See FIG. 1.) The handle assembly 60 of this first, preferred embodiment of FIG. 1 includes a coupling shaft 61 which interfaces with the coupling channel 42 of the post coupling portion 19; whereby, as the coupling shaft rotates, so rotates the post 14. In the disclosed embodiment of FIG. 1, the coupling shaft 61 includes a tip 62 (seen in FIG. 4B) conforming in shape to the coupling channel 42 of the post 14. The handle assembly 60 also includes a mechanism, such as a grip handle or lock cylinder, for effecting rotation of the coupling shaft 61.

Figure 4B:
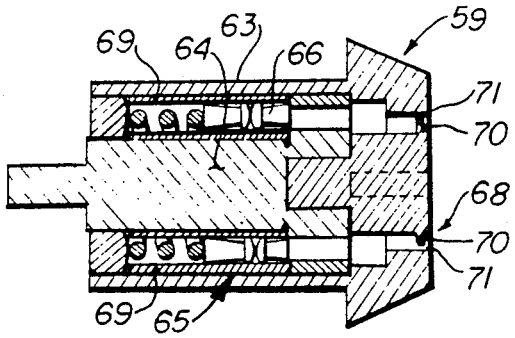
FIG. 4B is a view of the lock assembly of FIG. 4A, cutaway along line 4B—4B of FIG. 4A.

In the preferred embodiment of FIG. 1, the handle assembly 60 embodies a lock assembly 59. The lock assembly 59 of the preferred embodiment, seen in FIG. 4B, is of a type generally known in the art comprising a casing 63, a core 64 and a locking linkage 65 between the core and the casing, whereby, when the linkage 65 is unlocked, as by a key 67, the core is rotatable about an axis within the casing and, when the linkage is locked, the core and casing are prevented from relative movement. The locking linkage typically comprises an outer tumbler ring 69 affixed to the casing 63 and a plurality of tumblers 66 which block relative movement of the outer tumbler ring 69 (and casing 63) and core 64 and which are aligned by the proper key 67 to allow such relative movement. Examples of acceptable lock assemblies are those disclosed in U.S. Pat. Nos. 4,683,739 and 4,716,749; and additional detailed explanation of such lock assemblies is deemed necessary only to the extent required to understand the improvements made thereto by the present invention. The lock assembly 59 is mounted in the coupling chamber 49 with the casing 63 held against movement relative to the support housing 45 by a set screw or pin 58.

Figure 4A:
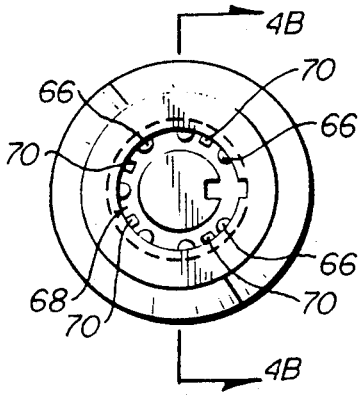
FIG. 4A is an isolated, end view of a lock assembly from the Latching System of FIG. 1.
Figure 4C:
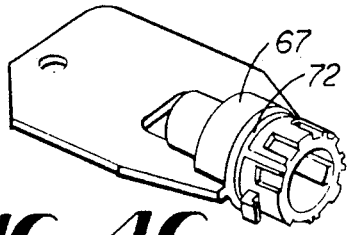
FIG. 4C is an isolated view of a key associated with the lock assembly of FIG. 4A.

With reference to FIGS. 4A–4C, improvements to the lock assembly 59 are detailed. The coupling shaft 61 of the present invention is an extension of, or is otherwise connected to the core 64. The key entry channel 68 of the lock assembly 60, in accordance with the preferred embodiment of the present invention is defined with a plurality of knobs 70 which protrude inward from the outer lip 71 toward the core 64. The knobs 70 are displaced about the circumference of the outer lip 71 at locations offset from the locations of the tumblers 66. The knobs 70 extend inward a distance similar to the inward extension of the tumblers 66 (see FIG. 4A). The key 67 as seen in FIG. 4C has been modified to include an additional annular slot 72 to accommodate the knobs 70 obstructing the key entry channel 68.

Figure 5A:
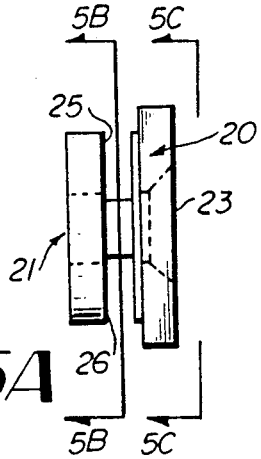
FIG. 5A is an isolated, side view of a latch housing of the Latching System of FIG. 1, with certain component portions removed.
Figure 5B:
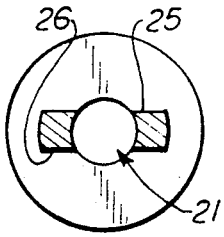
FIG. 5B is a view of the element of FIG. 5A, taken along line 5B—5B of FIG. 5A.
Figure 5C:
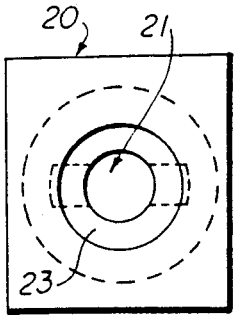
FIG. 5C is a view of the element of FIG. 5A, taken along line 5C—5C of FIG. 5A.
Figure 6A:
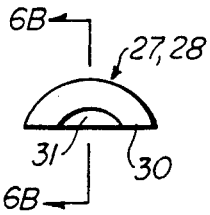
FIG. 6A is an isolated end view of a latch element of the post latching assembly of FIG. 1.
Figure 6B:
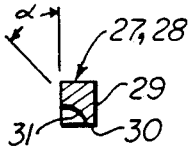
FIG. 6B is a side view of the latch element of FIG. 6A.
Figure 6C:
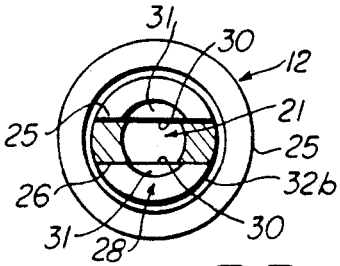
FIG. 6C is an isolated view of the post latching assembly of the Latching System of FIG. 1, taken along line 6C—6C of FIG. 1.

The latching assembly 12 (refer to FIGS. 1 and 5A–5C) includes a latch housing 20 formed with an axial passage 21 for accepting the latching portion 15 of the post therein. The post entry end 23 of the axial passage 21 is flared as with a chamfer. The latch housing 20 of the preferred embodiment is also formed with two opposing radial slots 25, 26 which slots are cut deep enough into the housing 20 to breach the axial passage 21. As seen in FIG. 1, positioned within each of the radial slots 25, 26 is a latch element 27, 28. The latch elements 27, 28 (refer to FIGS. 6A and 6B) are formed as semicircular plates with their straight edges 30 inserted into the respective radial slot 25, 26 such that the straight edges protrude into the axial passage 21 of the housing 20. In the preferred embodiment, the straight edges 30 of the latch elements 27, 28 are tapered (in a semicircular region of taper 31) as seen in FIGS. 6A and 6B; and the latch elements are oriented within the slots 25, 26 with the taper 31 oriented relative to the post entry end 23 of the axial passage 21 as shown within FIG. 1. The latch elements 27, 28 are retained within the radial slots 25, 26 by an elastic member 32. In the preferred embodiment, the elastic member 32 is comprised of two O-rings **32*a*, 32*b*. The O-rings 32*a*, 32*b*, in their normally compressed mode, bias the latch elements 27, 28 to their most radially inward position with the straight edges 30 pressed against the inner surfaces 25*a*, 26*a* of the radial slots 25, 26 (refer to FIGS. 5B and 6C). The O-rings allow the latch elements 27, 28 to move temporarily, radially outward in response to an outward force at the straight edges 30; and the o-rings return the latch elements to their inward position when such force is removed. As seen in FIG. 1, a cylindrical, protective sleeve 33 removably covers the radial slots 25, 26**.

Operation. To operate the primary latching function of the latching system 10, the post 14 is rotated to align the rows of teeth 38 of the post latching portion 15 with the latch elements 27, 28 of the post latching assembly 12. To release the primary latching function, the post 14 is rotated to move the rows of teeth 38 out of alignment with the cam elements 27, 28.

In the preferred embodiment, the post assembly 11 is mounted, as by the mounting assembly 44, to, for example, a door 78; and the post latching assembly 12 is mounted, as by the latch housing 20 to, for example, the related door frame 75. The post assembly and latching assembly 12 are so aligned that, when the door 78 is closed, the post latching portion 15 engages and protrudes into the axial passage 21 of the latch housing 20. The lock assembly 59 is inserted into the coupling chamber 49 of the support housing 45 with the tip 62 of the coupling shaft 61 interfacing with the coupling portion 19 of the post 14. Before setting the lock assembly casing 63 tightly in place and before closing the door 78 for the first time, the core 64 is assured to be in the locked position relative to the tumbler ring 69 and casing 63, and then the entire lock assembly 59 is rotated about the central axis 80, thus rotating the post 14 about the central axis. This lock assembly 59 rotation is done to align the rows of teeth 38 on the post 14 with the latch elements 27, 28, as represented in FIG. 1. Once the alignment is accomplished, the latch assembly 12 is set tightly in place relative to the frame 75. Now, with the lock assembly 59 in the locked position, as by operation of the key 67, when the door 78 is closed, the rows of teeth 38 of the post 14 are, upon protrusion of the post latching portion 15 into the axial passage 21, engaged by the latch elements 27, 28. As the tapered leading surfaces 39 of the teeth 38 contact the tapered surfaces 31 of the latch elements 27, 28, the resultant force overcomes the elastic bias of the O-rings 32 and the latch elements move to allow entry of the post 14 into the latching assembly 12 until the door is completely closed.

If it is attempted to remove the post latching portion 15 from the axial passage 21, the radially extending trailing surfaces 40 of the teeth 38 will strike flatly against the radially extending, nontapered surfaces 29 of the latching element straight edges 30. Thus the post 14 will not be removable. This is the primary latching function. The door 78 is now latched to the frame 75 and can only be opened by inserting the key 67 into the lock assembly 59 and turning the core 64 within the casing 63. When the key is turned, the coupling shaft 61 turns the post 14 to move the rows of teeth 38 out of alignment with the latch elements 27, 28 and move the smooth surfaces 18 into alignment with the latch elements. The door can now be opened as the post will move freely out of the latching assembly 12. Before the door 78 is again closed core 64 is returned to the locked position by the key, where the rows of teeth 38 will again be aligned with the latch elements 27, 28.

Operation of the additional security feature of the key channel blocking knobs 70 is as follows. One of the popular methods of "lock-picking" utilizes "picks" (i.e. rigid, thin wires) which are inserted through the key entry channel 68 to depress the tumblers 66—one pick depressing each tumbler, whereby a bundle of picks now protrude from the key entry channel. Once all tumblers are depressed, this bundle of picks must be rotated, with the inner core 64, relative to the casing 63 to effect the unlocking action. The function of the knobs 70 is to block the rotation of the bundle of picks and, thus, prevent relative rotation of the core 64 and casing 63. Unlocking with the use of picks is thus resisted. The knobs 70 do not prevent use of the key 67, since the key, in accordance with the present invention, is formed with the annular slot 72 and axial grooves 74 which accommodate the knobs during rotation of the key.

EMBODIMENT OF FIGS. 7-9

Figure 8B:
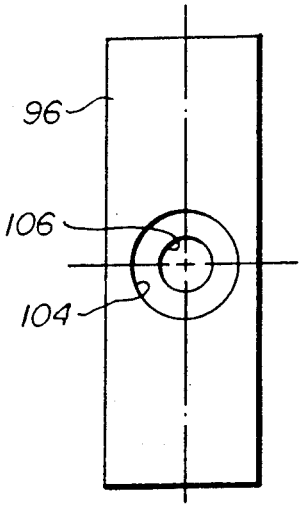
FIG. 8B is an end view of the lock housing of FIG. 8A, seen from the left side of FIG. 8A.
Figure 8A:
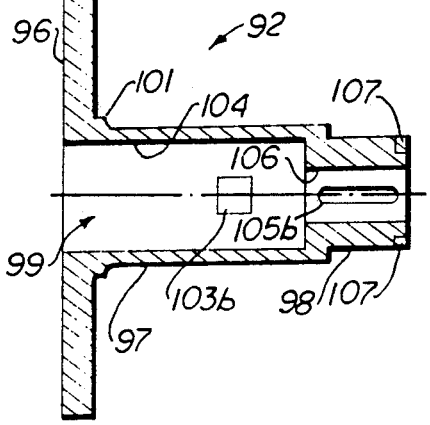
FIG. 8A is an isolated, cutaway view of the lock housing of the Latching System embodiment of FIG. 7A.
Figure 8C:
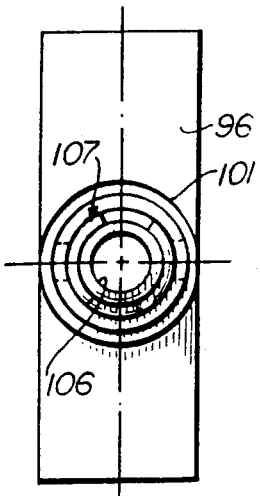
FIG. 8C is an end view of the lock housing of FIG. 8A, seen from the right side of FIG. 8A.
Figure 8E:
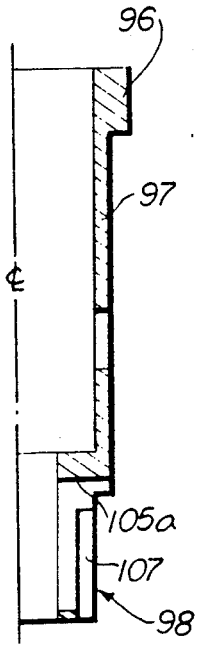
FIG. 8E is a view of the lock housing of FIG. 8A taken along line 8E—8E of FIG. 8D.
Figure 8D:
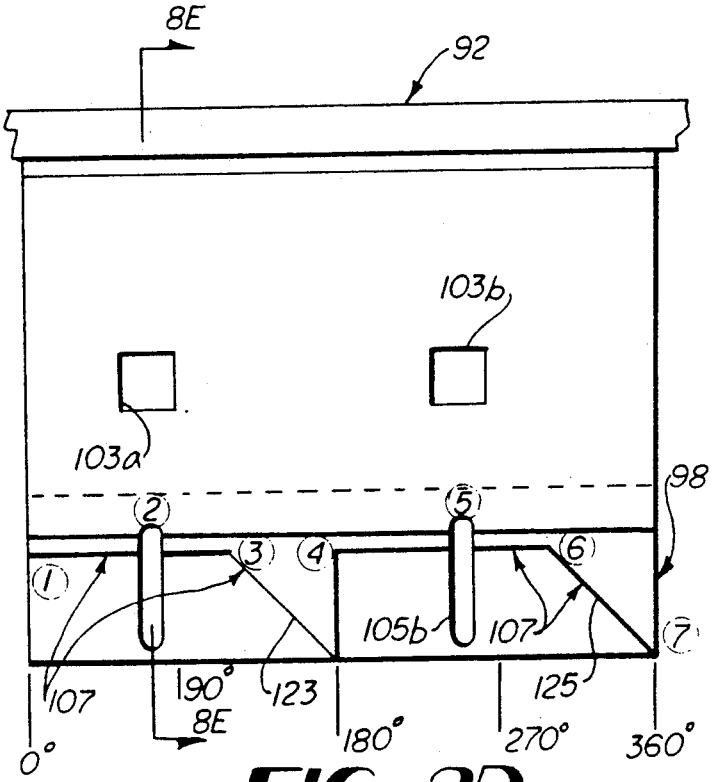
FIG. 8D is a representative cam diagram defining the cam surface, of the lock housing of FIG. 8A.
Figure 9B:
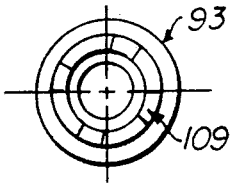
FIG. 9B is an end view of the cinch cam of FIG. 9A, seen from the right side of FIG. 9A.
Figure 9A:
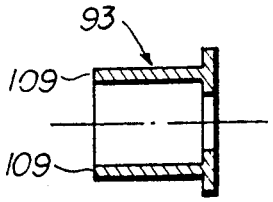
FIG. 9A is a side view of a cinch cam associated with the Latching System embodiment of FIG. 7A.

FIGS. 7-9 illustrate an alternate, preferred embodiment of the Latching System 10, in accordance with the present invention. In this embodiment, the Latching system 10 comprises the post assembly 11', the post latching assembly 12, the handle assembly 60' and the mounting assembly 44'. In this embodiment, the handle assembly 60' effects a cinching function not disclosed with the Embodiment of FIG. 1. Furthermore, the embodiment of FIGS. 7-9 define certain features which facilitate retrofit of the present invention to framework of existing, installed vending machines and the like.

The mounting assembly 44' of this embodiment is of a design standard in the prior art, which design is utilized widely throughout, for example, the vending machine industry. This mounting assembly 44' includes a deep, cylindrical segment 84, defining a chamber therein, with an axially centered cylindrical passage 85 formed through the back wall of the chamber. At the front of the mounting assembly 44', a generally rectangular, wall attachment segment 87 extends from the cylindrical segment 84. This wall attachment segment 87 is seen as defining a rectangular, cradle portion 88 recessed into the wall attachment segment. Though not seen, at least one, generally square, portal is defined in the cylindrical wall of the cylindrical segment 84, positioned, for example, in the section which has been cut away from FIGS. 7A and 7B.

Figure 7A:
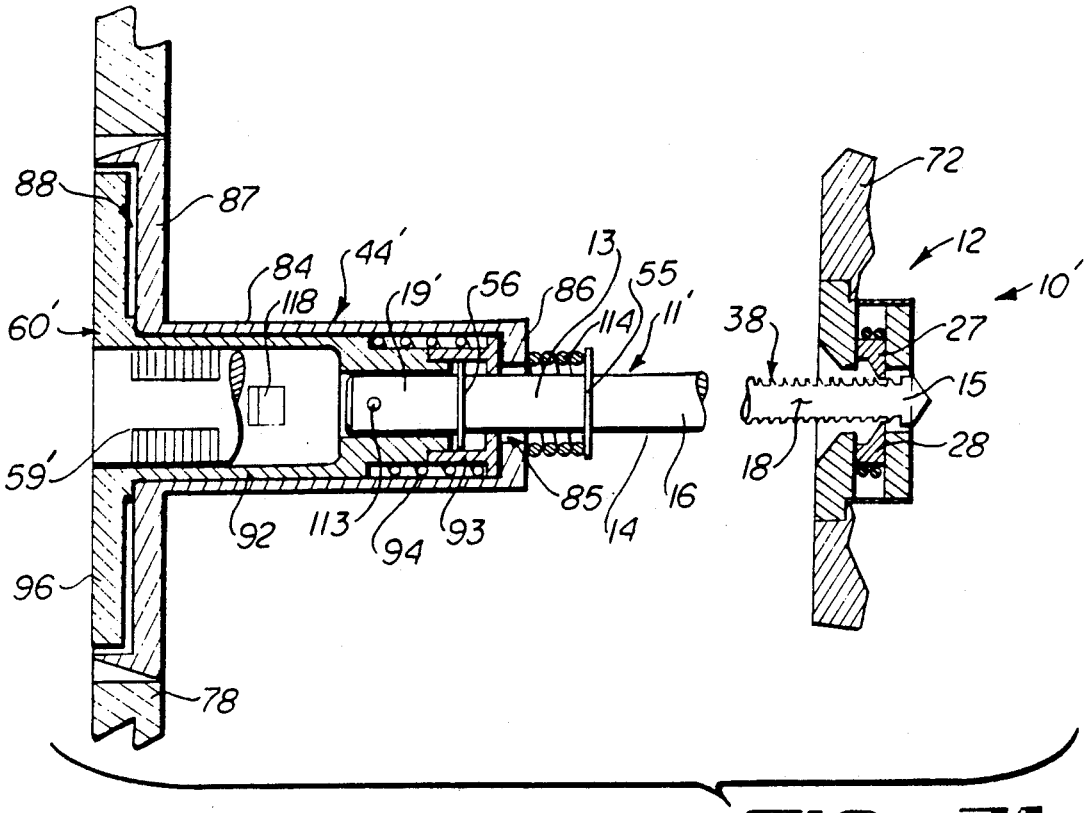
FIG. 7 is an isolated view of a portion of an Improved Latching System in accordance with the present invention, depicting an alternate embodiment to that of FIG. 1, and showing the System in the locked (and cinched) position.
FIG. 7B is a side view of the portion of the Latching System of FIG. 7A, showing the System in the unlocked (and un-cinched) position.
Figure 7B:
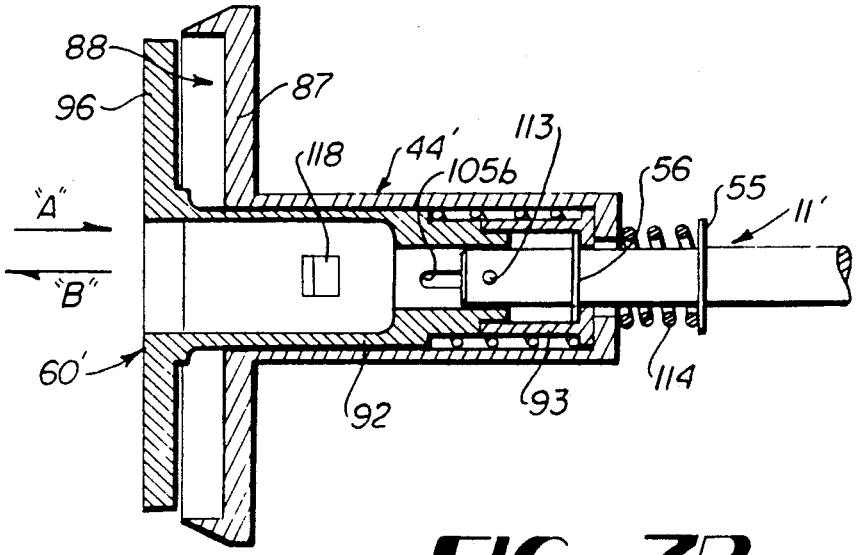

As seen in FIGS. 7A and 7B, the handle assembly 60' includes a lock housing 92, a cinch cam 93 and a spring 94. With reference to FIGS. 8A-8E, the lock housing 92 is seen as being formed with a grip handle portion 96, a barrel portion 97 and a cam portion 98. The grip handle portion 96 is in the form of a rectangular block relatively dimensioned to fit snugly into the recessed cradle portion 88 of the housing assembly 44'. In one preferred construction, as illustrated in the present drawings, of this embodiment of FIGS. 7-9, the grip handle portion 96 is formed with a narrow, cylindrical shoulder 101 which cleverly facilitates acceptable retrofitting to many pre-existing mounting assemblies 44' of established relative dimensions. An axial passage 99 extends through the lock housing 92, varying from the wider, lock support chamber 104 to the narrower, post support chamber 106. At least one, generally square portal 103 is defined in the cylindrical wall of the barrel portion 97 of the handle assembly 60'. The embodiment of the drawings shows two such portals **103*a*, 103*b*, displaced 180 degrees apart about the barrel 97 wall. The cam portion 98 is seen in FIG. 8A and 8D as being defined with two opposing (180 degrees displaced) axial slots 105. The cam surface 107 of the lock housing cam portion 98 is detailed in 360 degree rolled out fashion, as understood in the art, in FIG. 8D**.

Figure 9C:
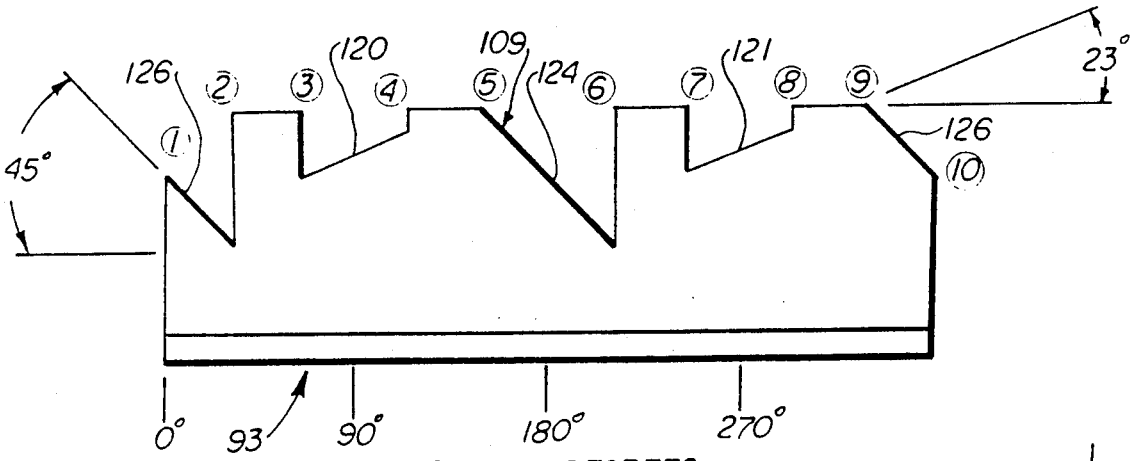
FIG. 9C is a representative cam diagram defining the cam surface of the cinch cam of FIG. 9A.

The cinch cam 93 of the handle assembly 60' is seen as a separate component mounted for rotation within the cylindrical segment 84 of the mounting assembly 44' (see FIGS. 7A and 7B). The cam surface 109 of the cinch cam 93 is defined about a cylindrical body portion 110 (see FIG. 9A); and this cam surface 109 is detailed in 360 degree rolled out fashion in FIG. 9C. Note that the cam details of FIG. 8D and 9C depict matching, interactive cam surfaces between surface segments 123/125 of the lock housing cam 98 and surface segments 124/126 of the cinch cam 93. The cinch cam 93 is caused to rotate within the cylindrical segment 84 of the mounting assembly 44' by the force applied by depressing the lock housing 92. As oriented in the drawings, the cinch cam 93 will rotate clockwise. The clockwise rotation causes cam surface segments 120 and 121 to exert a "pulling force" on the guide pins 113. Pulling pin 113 will cause the desired cinching action.

The post assembly of the embodiment of FIGS. 7-9 is similar to that of FIG. 1, however, the coupling portion 19' defines a diametrically extending guide pin 113 protruding radially outward in opposing directions from the post. As seen in FIGS. 7A and 7B, the mounting portion 13 of the post 14', upon assembly of the Latching System 10', extends into the cylindrical segment 84 of the mounting assembly 44' through the back passage 85; and then the coupling portion 19' of the post 14' extends into the axial passage 106 of the lock housing cam portion 98. The guide pin 113 extends into and through the two axial slots 105 (on each side of the lock housing cam portion 98). Furthermore, a biasing spring 114 encircles the mounting portion 13 of the post 14' between the mounting assembly back wall 86 and the external locking ring 55.

A lock assembly 59' is mounted in the axial passage 104 of the lock housing barrel portion 96 as shown. The lock assembly 59' is of a type known in the art, as described with respect to the embodiment of FIG. 1, and preferably including the improvements described with respect to FIGS. 4A-4D. In this embodiment of FIGS. 7-9, the lock assembly 59' does not couple directly with the post 14'. Rather, the lock assembly 59' includes a bolt element 118 which is aligned with one of the square portals 103 in the lock housing barrel 97. In manner known in the industry, when the lock assembly 59' is the locked position, this bolt element 118 extends immovably, radially out of the two portals 103; and when the lock assembly is in the unlocked position, this bolt element 118 is retracted (i.e. so as not to protrude out of the portal).

With the apparatus of the Embodiment of FIGS. 7-9 assembled as understood from the above description and/or from the drawings, operation is as described below. The embodiment of FIGS. 7-9 has, basically four positions (although other intermittent positions will be apparent): (i) the latched/unlocked position: (ii) the latched/locked/cinched position; (iii) the cinched/-locked/unlatched position; and (iv) the unlocked/unlatched position. The orientation of components as depicted in FIGS. 7A and 7B is the latched position. That is, both FIGS. 7A and 7B depict the latched position of the Latching System 10' of this embodiment of the present invention. FIG. 7A is, however the latched/-locked/cinched position; FIG. 7B is the latched/unlocked position. With the rectangular grip handle portion 96 aligned with the rectangular cradle portion 88 of the mounting assembly 44', the notched surfaces 17 of the post latching portion 15 are in line with the latch elements 27, 28 of the post latching assembly 12. Thus, both orientations of FIGS. 7A and 7B are latched. To unlatch the Latching System 10', one must first achieve the latched/unlocked position (FIG. 7B) and then rotate the grip handle portion 96 90 degrees relative to the mounting assembly 44'. In this way, the entire lock housing 92 rotates and, by virtue of the interconnection of the post guide pin 113 and the lock housing axial slots 105, the post is rotated 90 degrees to align the smooth surfaces 18 of the post latching portion 15 with the latch elements 27, 28 of the latching assembly 12—thereby allowing removal of the post 14' from the latching assembly 12.

Moving from the latched/unlocked position of FIG. 7B to the latched/locked/cinched position of FIG. 7A, and vice versa, requires the approximately simultaneous functioning of two mechanisms—the locking mechanism and the cinching mechanism.

The locking mechanism functions as follows for the unlock-to-lock sequence: Beginning in the position of FIG. 7B, the lock assembly 59' is placed by use of the key 67 with the core 64, tumbler ring 69 and casing 63 locked relative to one another. With the relative locking, the bolt element 118 is extended outward through one barrel portal **103*a*. The lock housing 92 is then pushed into the cylinder segment (direction of Arrow "A" of FIG. 7B). Note that the spring 94 is compressed by this relative movement. The bolt element 118 is spring loaded and is shaped to be tapered on one face and flat on the other face, in a manner known in the industry, so as to allow axial movement of the lock housing 92 through the mounting assembly cylinder 84 until the barrel portal 103*a* of the lock housing (and, thus, the bolt element 118) is in radial alignment with the portal (not seen) formed in the cylinder wall 84 of the mounting assembly 44'. At the point of alignment, the bolt element 118 springs radially into the mounting assembly portal where the flat face of the bolt element 118 engages the mounting assembly portal and prevents movement of the lock housing 92 in the direction of arrow "B" relative to the mounting assembly. The Latching System 10'** is now locked.

Simultaneously with the performance of the locking function, the cinching function is being performed. As the lock housing 92 is pushed into the mounting assembly cylinder 84, the post guide pin 113 (protruding through the elongated, axial slots 105 of the lock housing) is riding on the cam surface 109 of the cinch cam 93. Specifically, one side of the guide pin 113 rides on the cam surface segment 120 between points marked "3" and "4" in FIG. 9C; and the other side of the pin 113 rides on the cam surface 121 between the points marked "7" and "8" in FIG. 9C. At the same time, the cam surface 123 of the latch housing cam 98 is engaging the cam surface 124 of the cinch cam 93; and the cam surface 125 of the latch housing cam 98 is engaging the cam surface 126 of the cinch cam 93. As the latch housing 92 is pushed into the mounting assembly cylinder 84, the interaction between the respective cam surfaces 123-124 and 125-126 causes the cinch cam 93 to rotate about the central axis 80; and as the cinch cam rotates, the post guide pins 113 ride "up" the cam surfaces 120, 121, whereby the post 14' is drawn further into the mounting assembly 44'. This action compresses the biasing spring 114. This is what is referred to as the "cinching" action.

Moving from the latched/locked/cinched position of FIG. 7A to the latched/unlocked position of FIG. 7B is accomplished by turning the key 67 of the locking assembly 59' to thus "unlock" the locking assembly. The unlocking, in a manner known in the industry, retracts the bolt element 118, clearing it of the mounting assembly portal (not seen) and allowing movement of the lock housing 92 in the direction of arrow "B" relative to the mounting assembly 44'. Seizing on this opportunity, the compressed handle spring 94 pushes the lock housing 92 in the direction of arrow "B" to a distance limited by the interactive parts. At the same time, the biasing spring 114 withdraws the post 14' from the mounting assembly 44' to a distance limited by the interactive parts. As the post 14' is withdrawn, the guide pin 113 again moves along the cinch cam surfaces 120, 121 causing the cinch cam to rotate back to its previous orientation (i.e. prior to original cinching) in preparation for the next cinching function.

Moving from the latched/unlocked position of FIG. 7B to the unlatched/unlocked position is accomplished by rotating the handle assembly 60' ninety degree (90°) relative to the mounting assembly 44', by gripping and turning the grip handle portion 96. This action results in rotation of the post assembly 11' which is pinned to the handle assembly 60' by the guide pins 113 in the axial slots 105. Rotation of the post assembly 11' moves the rows of teeth 38 of the post 11' out of alignment with the latch elements 27, 28 of the latching assembly 12 and moves the smooth surfaces 18 of the post into alignment with the latch elements. The latching system 10' is now unlatched and the door 78 can now be opened.

It will be understood that, depending upon the need, a user may choose not to take advantage of the cinching function to draw the door and door frame closer together. This choice may be made, for example, in the case of a new vending machine where the door/frame interface is still quite tight. As the machine ages, the use of the cinching function may be more desirable. If one chooses not to use the cinching function for cinching the door, then the user places the handle assembly 60' in the cinched/locked/unlatched position before he/she closes the door to engage the post latching portion 15 and the latching assembly 12. The cinched/locked/unlatched position is identical to the latched/locked/-cinched position of FIG. 4A, except that the post latching portion 15 is not yet inserted into the latching assembly 12. Thus, the procedure for placing the handle assembly 60' in the cinched/locked/unlatched position is similar to placing it in the latched/locked/cinched position as explained above.

However, if the user desires to take advantage of the cinching function to draw the door and frame closer together, then the user leaves the handle assembly 60' in the latched/unlocked position (FIG. 7B) until after he/she has closed the door to engage the post latching portion 15 and the latching assembly 12; and after the notched surfaces 17 are latched by the latch elements 27, 28, the user pushes in the lock housing 92 (direction arrow "A" of FIG. 7B) to effect the cinching action and thus, as the post 14' is drawn into the mounting assembly 44', the door will be draw nearer to the door frame.

Figure 10:
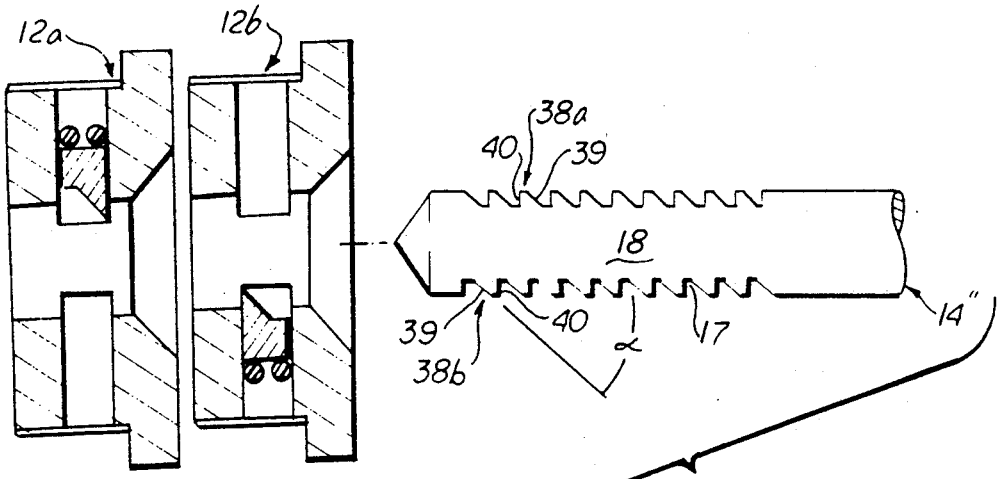
FIG. 10 is an isolated, side view of a portion of an Improved Latching System in accordance with the present invention, depicting an second, alternate embodiment to that of FIG. 1.

In still other alternate embodiments, the latching portion 15 of the post assembly 11 is defined with other arrangements of teeth 38. For example, but without limiting the possible alternatives, one embodiment includes two rows of teeth 38 which rows are disposed 180° apart about the post 14, and where the teeth of one row are in opposite orientation to the teeth of the other row. See FIG. 10. This post 14'' functions in conjunction with two latching assemblies 12*a*, 12*b* which are fixed relative to one another. One of the latch assemblies 12*a* is oriented to latch with one of the rows of teeth and the other latch assembly is oriented to latch with the other row of teeth. The allowed axial movement of the post is controlled by rotating the respective latching assemblies 12*a*, 12*b*, rather than rotation of the post. Other embodiments have the rows of teeth displaced 90° apart about the post.

Whereas the foregoing preferred embodiments of the present invention are shown and described as including tapered teeth 38 with tapered edges 39 and tapered latch elements 27, 28 with tapered edge 31, alternate embodiments are acceptable wherein either the teeth 38 or the latch elements 27, 28 are "square"; that is, either the teeth 38 are straight notches (without tapered surface 39) or the latch elements 27, 28 are straight (without taper 31).

Figure 11:
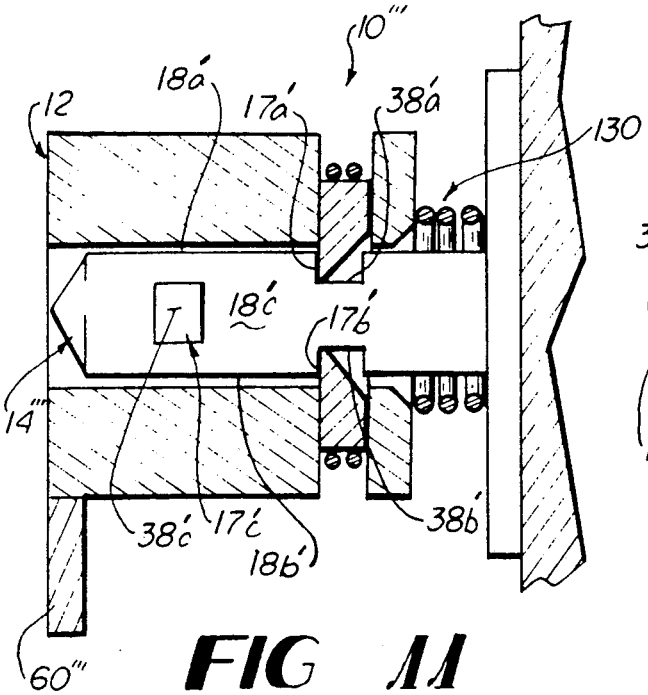
FIG. 11 a side view of an Improved Latching System in accordance with the present invention, with parts cut away for clarity, and showing a third, alternate embodiment to that of FIG. 1.
Figure 12:
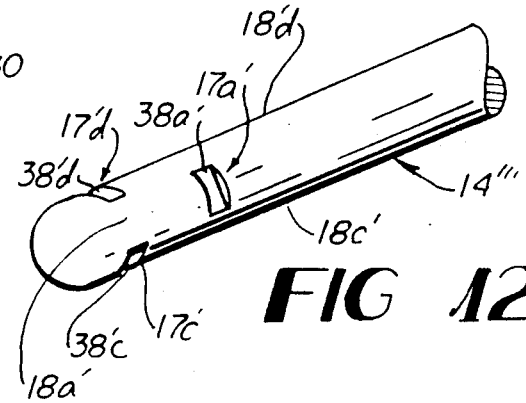
FIG. 12 is a isolated, perspective view of the post of the Improved Latching System of FIG. 11.

Still another embodiment of the Improved Latching System 10''' of the present invention, is seen in FIG. 11 and includes the post 14''' and the post latching assembly 12. The post 14''' comprises notched surfaces 17' displaced 90° apart about the post. Rather than a row of teeth 38, each of the notched surfaces 17' is defined with a single notch 38'. Two of the notched surfaces 17'*a* and 17'*b* lie in a first plane, yet 180° displaced about the post; and two other notched surfaces 17'*c* and 17'*d* lie 180° displaced from one another in a second plane, which is perpendicular to the first plane. The notches 38'*a* and 38'*b* of the first notched surfaces 17'*a*, 17'*b* are diametrically aligned with one another; and the notches 38'*c* and 38'*d* of the second notched surfaces 17'*c*, 17'*d* are diametrically aligned with one another. Notches 38'*a* and 38'*b* are axially displaced from the notches 38'*c* and 38'*d*. Furthermore, the post 14''' includes smooth surfaces 18' which are in axial alignment with each of the notched surfaces 17'. The latching assembly 12 of the embodiment of FIG. 11 is similar to that seen in FIG. 1. Preferably, in this embodiment, the handle 60''' (shown as simply a grip handle, although more complex handle and locking mechanisms are within the scope of this embodiment) is attached to the latching assembly 12 for rotation of the latching assembly and the post 14''' is rigidly held against rotation; although, in alternate embodiments, the post is rotated by the handle and the latching assembly is held against rotation. In operation of the preferred embodiment, the latching assembly 12 and post 14''' are engaged, displacing the latch elements 27, 28, and moved together until the latch elements are aligned with the first notches 38'*a* and 38'*b*. At this point, the latch elements 27, 28, "spring" into the notches 38'*a*, 38'*b* to provide the first, fixed position latch. To remove this first latch, the latching assembly 12 (or, alternately, the post 14''') is rotated 90°, thus again displacing the latch elements 27, 28 and aligning the latch elements with smooth surfaces 18'*c*, 18'*d*. The latching assembly 12 and post 14''' can now be moved relative to one another (for example, by the coil spring 130) until the latch elements 27, 28 are aligned with, and "spring" into, the second notches 38'*c*, 38'*d* to provide the second, fixed position latch. To remove this second latch, the latching assembly 12 (or, alternately, the post 14''') is again rotated 90°, thus again displacing the latch elements 27, 28 and aligning the latch elements with smooth surfaces 18'*a*, 18'b. It can be seen that the latching assembly 12 and the post 14''' can now be separated.

It is understood that the relative dimensions and relationships shown on the drawings are given as the preferred relative dimensions and relationships; but the scope of the invention is not to be limited thereby.

Whereas the present invention has been described in detail herein with specific reference to preferred embodiments thereof, it will be understood that variations and modifications can be effected within the spirit and scope of the invention as described hereinbefore and as defined in the appended claims.

I claim:

1. Latching apparatus for releasably latching a first door element, such as a vending machine door, or the like, and a second door element, such as a vending machine frame, or the like, said apparatus comprising:

a post member defining, at least, a multi-surfaced latching portion, which latching portion includes at least one axially extending notched surface and at least one axially extending smooth surface alternately disposed about the circumference of said post member;

a latching assembly comprising a passage for accepting said latching portion of said post member therein, and a latch means for effecting a grip on said notched surface when said latching portion of said post member is within said passage, thus resisting removal of said latching portion of said post member from said passage of said latching assembly; and a releasing means for releasing said grip between said notched surface and said latch means, thus facilitating removal of said latching portion of said post member from said passage of said latching assembly.

2. Apparatus of claim 1, wherein said post member is supported by one of the door elements so as to be capable of rotation about the elongated axis of said post member relative to the respective door element and wherein said latching assembly is supported by the other of the door elements.

3. Apparatus of claim 1, wherein said post member is fixed to one of the door elements and wherein said latching assembly is supported by the other of the door elements.

4. Apparatus of claim 1, wherein each of said notched surface and said smooth surface encircle less than the entire circumference of said latching portion.

5. Apparatus of claim 1, wherein said notched surface includes at least one notch, said notch comprising a radial surface, said radial surface defining a plane parallel to a radial plane of said post member.

6. Apparatus of claim 5, wherein said notch further comprises an inclined surface, said inclined surface defining a plane at an acute angle to a radial plane of said post member.

7. Apparatus of claim 1, wherein said notched surface comprises a plurality of notches, each notch of said plurality of notches comprising a radial surface defining a plane parallel to a radial plane of said post member and an inclined surface defining a plane at an acute angle to the radial plane of said post member.

8. Apparatus of claim 5, wherein said notched surface includes a second radial surface axially displaced from the first said radial surface and an axially extending flat surface interposed between the two said radial surfaces, said flat surface defining a plane perpendicular to said radial plane.

9. Apparatus of claim 1, wherein said latching portion of said post member defines a first notched surface and a second notched surface angularly displaced around the circumference of said post member from said first notched surface.

10. Apparatus of claim 9, wherein each said notched surface comprises at least one notch, said notch comprising a radial surface, said radial surface defining a plane parallel to a radial plane of said post member.

11. Apparatus of claim 10, wherein each said notch further comprises an inclined surface, said inclined surface defining a plane at an acute angle to a radial plane of said post member.

12. Apparatus of claim 9, wherein each said notched surface comprises a plurality of notches, each notch of said plurality of notches comprising a radial surface defining a plane parallel to a radial plane of said post member and an inclined surface defining a plane at an acute angle to the radial plane of said post member.

13. Apparatus of claim 12, wherein, relative to one another, said inclined surfaces of said notches of said first notched surface are oriented at a positive angle to the radial plane of said post member and said inclined surface of said notches of said second notched surface are oriented at a negative angle to the radial plane of said post member.

14. Apparatus of claim 1, wherein said apparatus comprises a second latching assembly axially displaced from the first said latching assembly, said second latching assembly comprising a passage for accepting said latching portion of said post member therein, and a latch means for effecting a grip on said notched surface when said latching portion of said post member is within said passage, thus resisting removal of said latching portion of said post member from said passage of said latching assembly.

15. Apparatus of claim 1, wherein said releasing means comprises means for effecting relative rotation between said post member and said latch means.

16. Apparatus of claim 15, wherein said means for effecting relative rotation between said post member and said latch means comprises means for rotating said post member relative to said latch means.

17. Apparatus of claim 15, wherein said means for effecting relative rotation between said post member and said latch means comprises means for rotating said latch means relative to said post member.

18. Apparatus of claim 1, wherein said apparatus further comprises a locking means for preventing said releasing means from releasing said grip.

19. Apparatus of claim 15, wherein said apparatus further comprises a locking means for preventing said releasing means from releasing said grip.

20. Apparatus of claim 16, wherein said apparatus further comprises a locking means for preventing said releasing means from releasing said grip.

21. Apparatus of claim 20, wherein said releasing means comprises a core means for transferring a rotational releasing force to said post member, said core means being rotatable with said post member.

22. Apparatus of claim 21, wherein said locking means comprises a casing and a locking linkage means for preventing rotation of said core means with respect to said casing.

23. Apparatus of claim 22, wherein said lock assembly further comprises a key entry channel and a plurality of protruding knobs which extend inwardly into said key entry channel, whereby said plurality of protruding knobs partially obstruct said channel, and wherein said apparatus further comprises a key means for entering said key entry channel and transferring rotational releasing force to said cylindrical core means, said key means comprising groove means for accepting said knobs therein, whereby the knobs track in the groove means as the key means enters said key channel and effects rotation of said core means.

24. Apparatus of claim 1, wherein said latch means comprises a movable latch element and biasing means for biasing said movable latch element to an inward position at least partially blocking said passage of said latching assembly.

25. Apparatus of claim 24, wherein said latch element comprises a front surface and a back surface, whereby during insertion of said latching portion of said post member into said cylindrical passage, said front surface engages said latching portion of said post member before said back surface engages said latching portion of said post member, said front surface defining a tapered surface constructed to, at least, engage said notched surface of said latching portion of said post member to facilitate insertion of said latching portion of said post member into said passage, said back surface defining a non-tapered, radially extending surface constructed to, at least, engage said notched surface of said latching portion of said post member to prevent removal of said latching portion of said post member from said passage.

26. Apparatus of claim 24, wherein said biasing means defines an elastic ring.

27. Apparatus of claim 25, wherein said latch assembly further comprises a latch housing which comprises said cylindrical passage and a radial aperture, said aperture associated with said latch means and providing a path of movement for said latch element.

28. Apparatus of claim 27, wherein said front surface of said latch element defines a tapered surface which cooperates with said notched surface of said latching portion of said post member during insertion of said latching portion of said post member into said cylindrical passage to transfer the insertion force of said post member into a force acting counter to said biasing force to effect movement of said latch element along said path defined by said radial aperture of said latch housing to facilitate insertion of said latching portion of said post member into said cylindrical passage.

29. Apparatus of claim 1, wherein said apparatus further comprises a cinch cam means for exerting an axial cinching force on said post member.

30. Apparatus of claim 29, wherein said apparatus further comprises a primary cylindrical cam means for exerting a primary axial force opposite said cinching force on said cinch cam means, wherein said post member further comprises a coupling segment and a radial pin which protrudes radially from said coupling segment, and wherein said cinch can means comprises a force-receiving cam surface and a force-exerting cam surface, said cinch cam means constructed to:

through said force-receiving cam surface, receive said primary axial force from said primary cylindrical cam means and convert said axial force into a rotational force which effects rotation of said cinch cam means, and through said force-exerting cam surface, convert said rotational force into said axial cinching force and transfer said cinching force to said coupling segment of said post member though said radial pin.

31. Latching apparatus for releasably latching a first door element, such as a vending machine door, or the like, and a second door element, such as a vending machine frame, or the like, said apparatus comprising:

a post member supported by one of the door elements, said post member including, at least, a coupling segment and a radial pin which protrudes radially from said coupling segment;

a latching assembly supported by the other of the door elements, said latching assembly comprising a passage for accepting at least a portion of said post member therein and means for effecting a grip on said post member when said post member is within said passage, thus resisting removal of said post member from said passage of said latching assembly;

a cinch cam means for exerting an axial cinching force on said post member, said cinch cam means comprising a force-receiving cam surface and a force-exerting cam surface; and a handle assembly comprising a releasing means for releasing said grip between said post member and said latching assembly, and primary cylindrical cam means for exerting a primary axial force opposite said cinching force on said cinch cam means, wherein said cinch cam means is constructed to:

through said force-receiving cam surface, receive said primary axial force from said primary cylindrical cam means and convert said axial force into a rotational force which effects rotation of said cinch cam means, and through said force-exerting cam surface, convert said rotational force into said axial cinching force and transfer said cinching force to said coupling segment of said post member though said radial pin.

32. Latching apparatus for releasably latching a first door element, such as a vending machine door, or the like, and a second door element, such as a vending machine frame, or the like, said apparatus comprising:

a post member defining, at least, a multi-surfaced latching portion, which latching portion includes at least one axially extending notched surface and at least one axially extending smooth surface alternately disposed about the circumference of said post member;

a latching assembly comprising a passage for accepting said latching portion of said post member therein, and, at least, one latch element protruding into said passage; and alignment means for changing the relative alignment of said post member and said latching assembly between (i) a latched alignment, while said latching portion is within said passage, wherein said latch element is in alignment with said notched surface, and (ii) an unlatched alignment, while said latching portion is within said passage, wherein said latch element is in alignment with said smooth surface, whereby, in said latched alignment, relative movement of said post member and said latching assembly is prevented in at least one axial direction, and, in said un-latched alignment, relative movement of said post member and said latching assembly in both axial directions is unprevented.

* * * * *